United States Patent [19]

Schuir et al.

[11] Patent Number: 4,648,184

[45] Date of Patent: Mar. 10, 1987

[54] KEYBOARD CONTROLLED APPARATUS FOR THE IDENTIFICATION OF SMALL PARTS

[75] Inventors: Alexander Schuir, Hanover; Franz Schrauder, Litzendorf, both of Fed. Rep. of Germany

[73] Assignee: F. Wieland Elektrische Industrie GmbH, Bamberg, Fed. Rep. of Germany

[21] Appl. No.: 701,069

[22] Filed: Feb. 13, 1985

[30] Foreign Application Priority Data

Feb. 17, 1984 [DE] Fed. Rep. of Germany ..... 3405658

[51] Int. Cl.[4] ..... B43L 13/00; B41F 17/00

[52] U.S. Cl. ..... 33/18.1; 400/19; 400/23; 400/160; 101/35

[58] Field of Search ..... 101/35, 4, 18; 400/23, 400/25, 48, 127, 128, 134.1, 160, 161, 162, 174, 19; 33/18.1, 18.2, 18.3

[56] References Cited

U.S. PATENT DOCUMENTS

| | | | |
|---|---|---|---|
| 3,739,898 | 6/1973 | Rooney | 400/161 |
| 3,894,731 | 7/1975 | Evans | 101/4 X |
| 4,254,552 | 3/1981 | Samis | 33/18.1 |
| 4,439,834 | 3/1984 | Dahlgren, Jr. et al. | 33/18.1 X |
| 4,467,525 | 8/1984 | Logan et al. | 33/18.2 |
| 4,523,865 | 6/1985 | Schacht | 400/134.1 X |

FOREIGN PATENT DOCUMENTS

| | | | |
|---|---|---|---|
| 2655958 | 6/1978 | Fed. Rep. of Germany | 101/4 |
| 166077 | 10/1983 | Japan | 400/25 |

*Primary Examiner*—Clifford D. Crowder

*Attorney, Agent, or Firm*—Jordan and Hamburg

[57] ABSTRACT

Apparatus for placing identification or indicia on parts of small surfaces, especially on identification labels of terminals for the identification of electrical components and circuits, whereby a printing or writing device is provided with a keyboard for selecting labeling symbols which preferably can be read on a display, as well as a guide for the bandoliered, sequenced parts to be labeled arranged opposite to the type carrier or writing device and a positioning device which carries out a stepwise relative shift between the parts and the type carrier or writing device.

6 Claims, 6 Drawing Figures

KEYBOARD CONTROLLED APPARATUS FOR THE IDENTIFICATION OF SMALL PARTS

This invention relates to an apparatus for placing identification or indicia on the surfaces of small parts, particularly on identification labels of terminals for identifying electrical parts or components and lines or circuits.

In many technical areas, the increasing miniaturization, especially in the area of electrical engineering has led to the development of parts and components of steadily decreasing external dimensions, and there exists the problem of placing identification indicia on small surfaces in an acceptably legible and rationalized method of operation.

Heretofore, the user of such identified small parts had three basic possibilities, i.e., firstly, utilizing electrical parts and components, such as for instance, terminal blocks which had already been provided with the corresponding information symbols by the manufacturer. Although this assures a clear and consistent presentation, it requires that the user or the manufacturer stock a considerable supply of information elements of various symbols, which is uneconomical and does not allow much flexibility.

The second possibility consists in utilizing electrical parts and components with information elements, whereby the user has to provide the information carrier with the corresponding information symbols, such as for instance, adhesive symbols or pull-off images. The considerable disadvantage of this method is that the user has to have a great supply of various, potentially needed information symbols, so that they can be placed on the information carrier as needed. This method is also highly uneconomical.

Finally, there is the third possibility of utilizing terminal blocks and the like with information elements which do not already have the information symbols placed on by the manufacturer, but whereby they are applied as needed by the user, i.e., by means of a crayon or the like. Although this possibility certainly assures the greatest flexibility, it does not assure clarity and consistency of presentation. Furthermore, it is also very time-consuming and therefore very costly.

The present invention is thus based on the technical problem of providing an apparatus for placing identification on small parts, allowing the user to quickly, simply and neatly provide the identification labels with various identification or indicia, whereby it would not only be possible to provide a multitude of labels with the same identification, but whereby it is also possible that each of a multitude of identification labels can be provided with a different imprint.

According to the present invention, the technical problem is solved whereby a printing or writing apparatus is provided with a program-controlled writing device, whereby the apparatus is equipped with a keyboard, a selection of the labeling symbols, which preferably can be read on a display, as well as a guide for the bandoliered, sequenced parts to be labeled, the guide being arranged opposite to the type carrier or writing device, and a positioning device causing a stepwise relative shift between the parts and the type carrier or writing device.

According to a first embodiment of the present invention, it is further provided that an opening is provided in the guide of the positioning device shifting the parts to be labeled in front of the cylindrical, ball-head or disk-shaped carrier. The individual small part positioned at that point is labeled through this opening by coming into contact with the section of the printer coated with printing ink, which has been selected by means of the keyboard.

The apparatus according to the present invention makes it possible to provide random, even various quantities of small parts with identification symbols and signs according to their type and the like. The identification symbols and signs are selected with the help of the keyboard from the inventory of symbols provided on a type carrier whereby, by means of a transmission device provided on the apparatus, the keyed-in identification becomes visible on a display for controlling the keyed-in input.

The fast method of operation of the identification apparatus according to the invention is achieved mainly by means of the bandoliered sequencing of the parts to be labeled. In an advantageous configuration of the invention, they are detachably positioned on or as a band-shaped carrier or are connected to a strip with interspaced ideal points of fractures. Because of this configuration, the required labeling can be performed almost as rationally as printing of relatively large surfaces of materials consisting of sheets or rolls.

Also included in the scope of the present invention is the utilization of the spatial configuration of the actual parts to be labeled for the control of their forward movement in the guide adjacent to the printer, which can be realized especially simply, if the parts to be labeled possess any kind of externally accessible recesses, such as for instance, frequently utilized U-shaped terminal parts with resilient prongs, whereby their shape can be utilized as an adjustment aid by arranging them in such a way that by the corresponding selection of their direction and of the distance between them, the positioning device with its preferably pin-shaped stop element extending into the guide engages in the recesses of the sequenced small parts to be identified.

Furthermore, for increasing the working speed of the identification apparatus according to the invention, electrical drive means for the movement of the printer and the preferable stepwise advancement of the parts to be labeled are provided.

In order to achieve an extensively self-acting, automatic functioning of the apparatus according to the invention, in a further embodiment of the invention, it can also be provided with a memory connected to the keyboard, as well as an electrical control apparatus which, after corresponding input by means of the keyboard, self-actingly controls the number, kind and sequence of the markings to be transmitted from the printer to the parts to be identified.

The above described first embodiment of the basic concept of an identification apparatus according to the present invention is suitable not only for the program-controlled selective individual labeling, i.e., labeling such identification carriers differently for each part, but also for a greater serial production of the same individual identification portions, which can then be processed, for instance, in the form of a breakable rolled-up strip.

A second embodiment of the identification apparatus according to the present invention can be realized especially simply, whereby instead of the printing device, there is provided a program-controlled writing device, such as already essentially known, for instance, for marking mechanisms in connection with technical drawings. Thus, writing devices mounted on a support arm which can be conveyed in three dimensions, as known from this marking automat are used, which write or draw the individual given symbol or a random series of symbols on the documents by means of traveling along the corresponding lines of the symbol. In order to utilize this single writing principle for the identification apparatus according to the invention, the embodiment of the present invention is characterized in that under the support arm of the writing device, there is arranged a console with guides for a preferably easily detachable adjustment frame, which holds the parts to be labeled.

By the provision of such an adjustment frame, it is without great problems assured that the parts to be labeled are always in the correct position below the writing device, so that it is not necessary to constantly have to perform readjustments. Thereby it is also possible to provide that the adjustment frame can be adjusted under stepwise control in one, or preferably two to each other perpendicular directions, in order to move the next part under the tip of the writing device. There could, of course, also be provided a stepwise controlled shifting embodiment of the writing device instead. Generally, it would be sufficient to provide a shifting embodiment for the adjustment frame perpendicular to the axis of the support arm of the writing device, because it is possible without problems to carry out the shifting of the support arm itself in a direction parallel to the axis. This special combination allows, therefore, in the simplest way the marking of an entire surface field, whereby the identification parts are held on the adjustment frame.

Further advantages, characteristics, and features of the present invention are set forth in the following description of two embodiments, as well as by means of the accompanying drawings.

BRIEF DECRIPTION OF THE DRAWINGS

DESCRIPTION OF THE PREFERRED EMBODIMENTS

Figure 1:
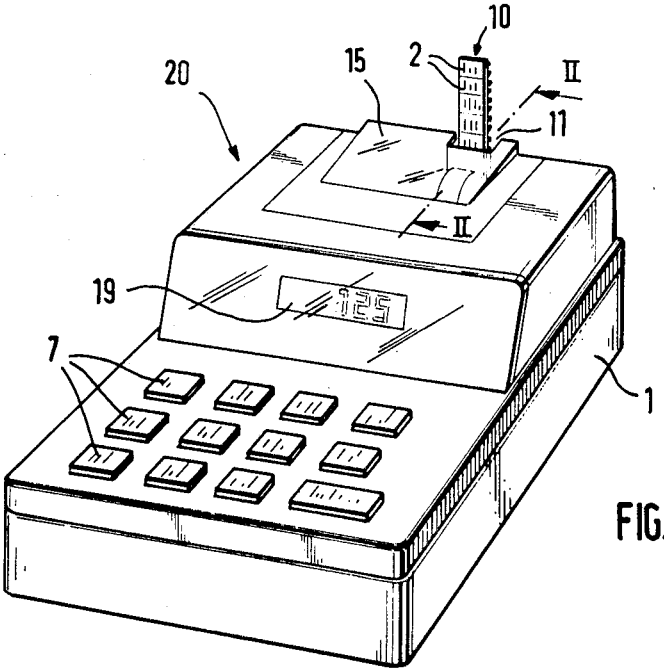
FIG. 1 is a perspective view of an apparatus with a printing device according to one embodiment of the invention configured in the fom of a desk-top model.
Figure 2:
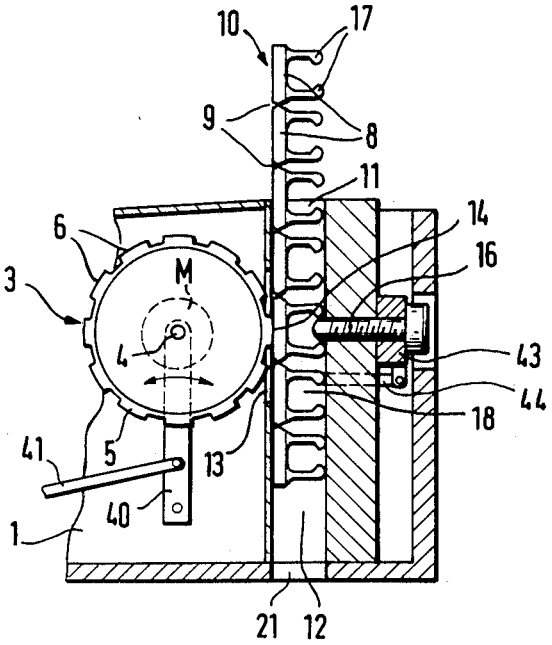
FIG. 2 is a cross-sectional view taken along the line II—II in FIG. 1.

According to FIGS. 1 and 2, the identification apparatus according to the present invention comprises a housing 1 which can be assembled and in which are contained all the elements required for its functioning, as well as conventional, not especially illustrated drive and control means. In the represented exemplified embodiment, the housing 1 furthermore contains the required printing device for applying schematically illustrated labeling symbols 2. A cylindrical type carrier 3 driven by an electrical motor M is rotatably positioned around its axis 4. Distributed over the circumference of the external jacket 5 of the type carrier 3 are labeling symbols 2, which are formed in its radially, outwardly-extending sections 6 of the jacket surface 5. For the selection of the individual desired labeling symbols 2, the type carrier 3 is connected to a keyboard 7 provided in the front part of the housing 1. By the manual operation of the keyboard 7 individual sections of the cylindrical type carrier 3 can be brought into their respective printing positions with reference to the parts 8 which are to be provided with an identification. Together with the motor, the type carrier 3 is supported by a rocking lever 40, so that for the setting of the individual symbol, it is shifted to the left by means of an adjustment lever 41 which is controlled via the keyboard 7 and is tilted to the right only for printing.

The invention, of course, is not limited to the utilization of a cylindrical type carrier. Instead, for instance, a ball-shaped type carrier head could also be utilized, or an endless band carrying the labeling symbols 2 superposed, for instance, on a cylindrical carrier element in the area where the transmission of the selected labeling symbols should take place onto the parts to be identified.

Because the apparatus according to the invention is intended mainly for the identification of parts of labeling fields of relatively small surfaces, the parts 8 are conveyed to the printer in a bandoliered, sequenced configuration, such as can be achieved, for instance, by providing a band-shaped auxiliary carrier on which the parts 8 are detachably arranged so that after the printing process, they can be easily removed from this auxiliary carrier band.

In the illustrated exemplified embodiment of FIGS. 1 and 2, the parts 8 to be labeled or identified, are connected to each other with interspaced ideal points of fracture 9 along a strip 10, which is conveyed through a passage 11 provided on the top of the housing 1 to the printing device positioned in the housing. A guide 12 is provided with an opening 13. Area sections 14 of the parts 8 to be labeled are guided along the opening 13. Each time a particular section thereof comes into the area of the opening 13, it comes into contact with the keyboard-selected section 6 of the external jacket 5 of the type carrier 3, and an imprint of the labeling symbol 2 is placed on the part 8. For this purpose, the raised sections of the external jacket 5 of the type carrier have to be correspondingly inked. The inking can be performed by means of an impregnating device, which is not illustrated, but which is provided inside the housing, or it can also be performed from the outside. In order to make the part of the housing 1 containing the printing device easily accessible for the inking process or also, for instance, for changing the cylindrical type carrier 3, in the area of the insertion opening 11, there is provided a removable plate 15 for the strip 10 with the parts 8 to be labeled.

In order to bring the individual area sections 14 to be labeled into their respective printing position in which they come into contact with the type carrier 3 through the opening 13 in the guide 12, a positioning device is provided which causes the corresponding stepwise advancement of the strip 10. Thereby it is also possible, as already initially mentioned, that the actual shape of the small parts 8 to be labeled is utilized for the adjustment whereby, for instance, a pin-shaped stop element 16, of which the movement is controlled by the positioning device, engages consecutively in the U-shaped spaces 18 formed by the resilient prongs 17 of the parts 8 to be provided with the identification.

In order to provide the user of the identification apparatus according to the present invention with a clear visual control of the labeling symbols 2 which are selected with the aid of the keyboard 7, the housing is provided with a display 19 on which the individually selected labeling symbols are displayed, for instance, in digital form.

In principle, the identification apparatus according to the present invention represented in the exemplified embodiment in the form of a desk-top model 20 could be provided exclusively with mechanical drive means, whereby operating the corresponding parts of the keyboard 7 causes the rotation of the type carrier 3 and the advancement and printing of the small parts 8 to be marked which are sequenced in the form of a strip 10.

A considerably greater working speed of the apparatus can be attained, however, if instead of exclusively mechanical operating means, the apparatus is provided with electrical drive means for the movement of the printing device and the advancement of the parts 8 to be labeled from the insertion opening 11 to their discharge 21 by means of the guide 12 which conveniently is also positioned inside the housing 1.

In addition, a further increase of efficiency of the apparatus and also of the automatic process of the labeling method can be attained, whereby the desk-top model 20 is provided with a memory S connected to the keyboard 7 or to a conventional computer, as well as a built-in electrical control device C which, in accordance with the corresponding program default input by means of the keyboard 7, independently performs the marking of the parts 8 which have to be identified according to number, kind and sequence by means of the printing device of the type carrier 3.

Figure 6:
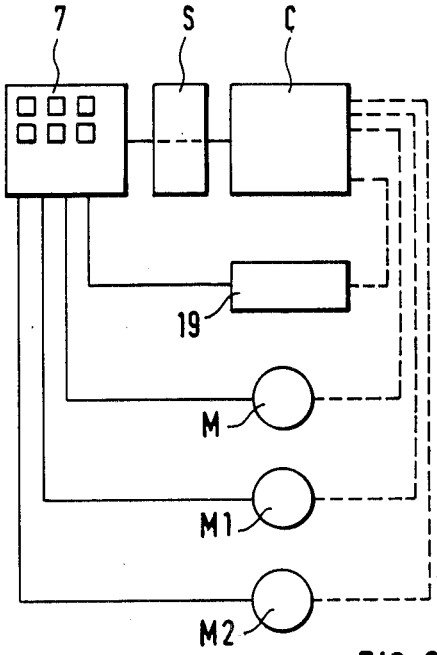
FIG. 6 is a diagram of the connections of the apparatus according to FIGS. 1 and 2.

FIG. 6 shows a schematic representation of the connections for the selective control of the motor M, the motor $M_1$ of the lever 41 and the motor $M_2$ which moves the stop element 16 by means of its adjustment rod 44 and the carrier element 43, either directly by means of the keyboard 7 or via the memory S and the program-controlled control apparatus C.

Figure 3:
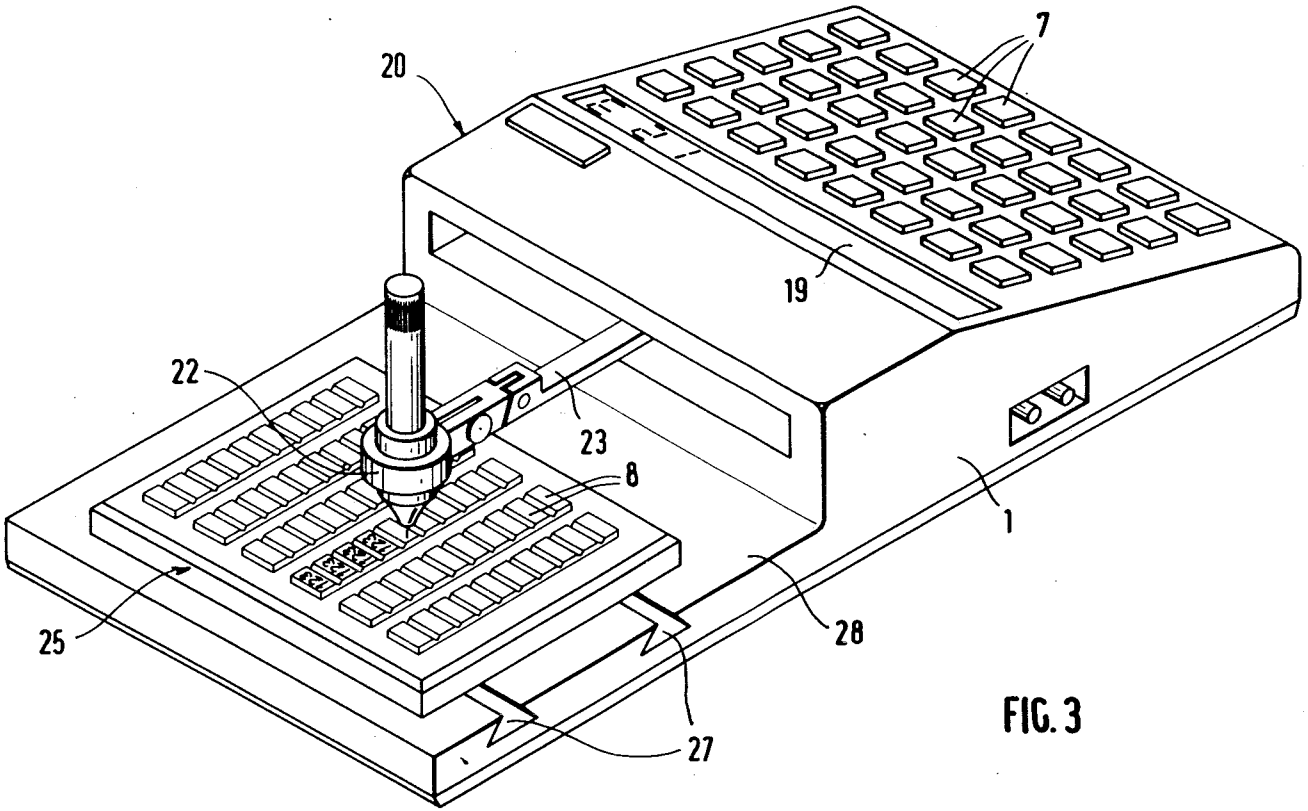
FIG. 3 is a perspective view of an identification apparatus according to another embodiment also configured in the form of a desk-top model utilizing a program-controlled writing device.
Figure 4:
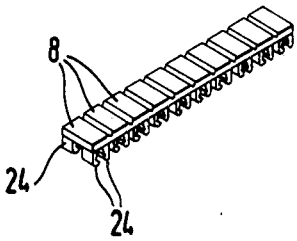
FIG. 4 is a perspective view of a strip consisting of a multitude of sequenced, individually detachable terminal identification labels.
Figure 5:
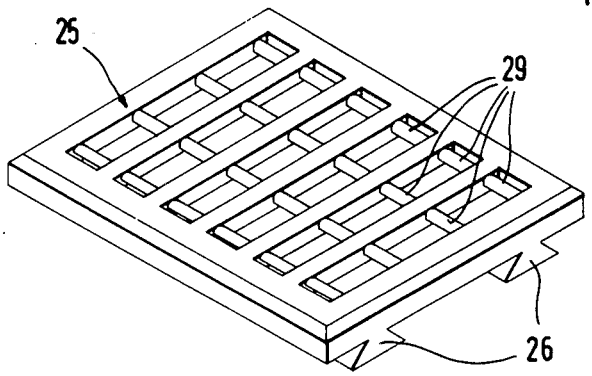
FIG. 5 is a perspective view of an adjustment frame which is detachably fastened on the console of the apparatus.

FIG. 3 shows a modified embodiment of an identification apparatus according to the present invention, wherein the corresponding parts are indicated with the same reference symbols as in FIGS. 1 and 2. Instead of the printing cylinder of FIGS. 1 and 2, FIG. 3 shows a writing device 22 which is interchangeably fastened on the front end of a support arm 23 guided by a driving device which is not illustrated in detail and which, furthermore, is known from marking automats. The writing device 22 is guided in accordance with a control program inside the desk-top model 20. During the selection of a labeling symbol via a key of the keyboard 7, which is again displayed on the display 19, the writing device marks the corresponding individual symbol individually on each part 8 to be labeled. In the embodiment according to FIGS. 3 to 5, these parts are identification labels with terminal arms 24 for clamping on correspondingly configured indentification saddles of electrical terminal blocks or the like, as have already been described above in connection with the first embodiment according to FIGS. 1 and 2. Preferably they are injected as individual parts which can be broken-off from a long strip. Regardless whether the small parts are present as individual parts or as strips, in order to be able to correctly position the parts 8 or components 8 below the writing device, there is provided a positioning frame 25 having dovetailed feed guides 26, which can be inserted into corresponding guides 27 of a console 28 of the housing 1. In the illustrated simplest embodiment of such an apparatus, the positioning frame 25 is manually shifted from row to row, whereby the labeling of the individual parts 8 takes place within a particular row by means of longitudinal shifting of the program-controlled support arm 23. Of course, there could also be provided an arrangement whereby the support arm could stepwise controlled travel over the entire field of the adjustment frame, or also, wherein a corresponding stepwise controlled mode of operation of the adjustment frame is provided on the console 28. As is especially recognizable in FIG. 5, the adjustment frame of the illustrated embodiment is provided with a few spaced traverse supports 29 corresponding to the construction of the identification saddles of electrical terminal blocks. The traverse supports 29 assure that the clamping arms 24 come to a stop and thus assure also an exact positioning of the individual parts 8 to be labeled.

We claim:

1. Apparatus for placing indicia on parts such as electrical components, circuits, terminals and the like comprising a housing, a program-controlled writing device within said housing and having a writing arm extending from said housing, a keyboard on said housing for operatng said writing device such that the keyboard is thereby operable to select the indicia to be applied by said writing device, a console support extending from said housing and generally underlying said writing arm, a frame for receiving said parts, said frame having a plurality of elongated part-receiving openings which are arranged side-by-side in parallel array to form a plurality of rows of said elongated openings, each of said elongated openings receiving an elongated strip of connected parts, support means disposed at said openings for supporting each elongated strip of connected parts in each of said elongated openings, and slide means on said console support and said frame for slidably supporting said frame on said console support such that the position of said frame is thereby adjustable, said writing arm extending from said housing to generally overlie said frame such that the writing arm is operable to write on said parts sequentially one after the other, whereby indicia is thereby applied to all of said parts on said frame.

2. Apparatus according to claim 1 wherein said support means comprises support members which extend perpendicular to the longitudinal extent of said elongated openings.

3. Apparatus according to claim 1 wherein said slide means comprises elongated parts on said frame and said console support, said elongated parts extending in a direction perpendicular to the longitudinal extent of said elongated openings such that said frame slides parallel to the longitudinal extent of said elongated parts.

4. Apparatus according to claim 3 wherein said writing arm is operable to advance parallel to the longitudinal extent of said openings sequentially from one connected part to the next connected part of a first strip such that the writing arm sequentially writes on all of the connected parts in said one strip as said frame is maintained stationary, and wherein said frame is slidable on said console support perpendicular to the longitudinal extent of said openings to sequentially dispose one row after the other in a position such that after the writing arm sequentially writes on all the connected parts in one strip, the frame is moved so that the writing arm writes on all the connected parts in another strip.

5. Apparatus according to claim 4 wherein said writing arm extends parallel to the longitudinal extent of said elongated openings.

6. Apparatus for placing indicia on elongated strips of connected parts such as electrical components, circuits, terminals and the like comprising a housing, a program-controlled writing device within said housing and having a writing arm extending from said housing, a keyboard on said housing for operating said writing device such that the keyboard is thereby operable to select the indicia to be applied by said writing device, a console support extending from said housing and generally underlying said writing arm, a frame for receiving said strips of connected parts, said frame having a plurality of elongated part-receiving openings which are arranged side-by-side in parallel array to from a plurality of rows of said elongated openings, each of said elongated openings receiving an elongated strip of connected parts, support means disposed at said openings for supporting each elongated strip of connected parts in each of said elongated openings, and slide means on said console support and said frame for slidably supporting said frame on said console support such that the position of said frame is thereby adjustable, said slide means comprising elongated parts on said frame and said console support, said elongated parts extending in a direction perpendicular to the longitudinal extent of said elongated openings, said writing arm extending from said housing to generally overlie said frame such that the writing arm is operable to write on said parts, said writing arm being operable to advance parallel to the longitudinal extent of said openings, sequentially from one connected part to the next connected part of a first strip such that the writing arm sequentially writes on all of the connected parts in said one strip as said frame is maintained stationary, and wherein said frame is slidable on said console support perpendicular to the longitudinal extent of said openings to sequentially dispose one row after the other in a position such that after the writing arm sequentially writes on all the connected parts in one strip, the frame is moved so that writing arm writes on all the connected parts in another strip, whereby indicia is thereby sequentially applied to all of said parts positioned on said frame.

* * * * *